US007722433B2

(12) United States Patent
Utaka

(10) Patent No.: US 7,722,433 B2
(45) Date of Patent: May 25, 2010

(54) CLOTHES WITH BACK PART SUCH AS BRASSIERE

(75) Inventor: Shohei Utaka, Kasai (JP)

(73) Assignee: Utax Co., Ltd, Hyogo (JP)

( * ) Notice: Subject to any disclaimer, the term of this patent is extended or adjusted under 35 U.S.C. 154(b) by 0 days.

(21) Appl. No.: 11/597,810

(22) PCT Filed: Feb. 3, 2005

(86) PCT No.: PCT/JP2005/001974

§ 371 (c)(1),
(2), (4) Date: Aug. 2, 2007

(87) PCT Pub. No.: WO2006/077658

PCT Pub. Date: Jul. 27, 2006

(65) Prior Publication Data

US 2008/0045122 A1 Feb. 21, 2008

(30) Foreign Application Priority Data

Jan. 21, 2005 (JP) ..... 2005-014136

(51) Int. Cl.
*A41C 3/00* (2006.01)

(52) U.S. Cl. ..... 450/79; 450/82; 450/63

(58) Field of Classification Search ..... 450/58, 450/63, 71, 73, 77, 79, 82; 2/96
See application file for complete search history.

(56) References Cited

U.S. PATENT DOCUMENTS 3,315,277 A 4/1967 Ruiz
3,575,750 A 4/1971 Sakamoto
4,256,529 A 3/1981 Clarke et al.
5,447,462 A * 9/1995 Smith et al. ..... 450/122
5,820,443 A * 10/1998 Burr ..... 450/40
5,916,829 A * 6/1999 Girard et al. ..... 442/244

(Continued)

FOREIGN PATENT DOCUMENTS

EP 2 146 492 8/2000

(Continued)

OTHER PUBLICATIONS

Supplementary European Search Report issued Mar. 3, 2008 in the European Application No. 05 71 0026.

*Primary Examiner*—Gloria Hale
(74) *Attorney, Agent, or Firm*—Wenderoth, Lind & Ponack, L.L.P.

(57) ABSTRACT

A garment includes a brassiere with a back part, in which back cloths are formed thin without concaves and convexs, and only head parts of male and female engaging devices appear on outer surfaces of the back cloths, thereby providing a stylish appearance, which is plane and neat, and providing a comfortable feeling without a feeling of discomfort when worn. The garment includes a back part of a brassiere or the like which can be freely put on and off by using the male and female engaging devices (12) and (16) provided to the back cloths (4) welded to an area from underarm parts toward a back of a wearer. The male and female engaging devices (12) and (16) are integrally attached onto inner surface portions of the back cloths (4). The head parts (12*a*) and (16*a*) of the male and female engaging devices (12) and (16) are exposed to an outside through slits (13).

8 Claims, 7 Drawing Sheets

U.S. PATENT DOCUMENTS

| | | | | |
|---|---|---|---|---|
| 6,837,771 | B2 * | 1/2005 | Falla | 450/39 |
| 7,128,635 | B1 * | 10/2006 | Liu | 450/39 |

FOREIGN PATENT DOCUMENTS

| | | |
|---|---|---|
| JP | 10-88405 | 4/1998 |
| JP | 2002-28009 | 1/2002 |
| JP | 3087144 | 4/2002 |
| JP | 2002-201505 | 7/2002 |
| JP | 2004-263315 | 9/2004 |
| JP | 3105465 | 9/2004 |
| WO | 2006/061861 | 6/2006 |

* cited by examiner

CLOTHES WITH BACK PART SUCH AS BRASSIERE

TECHNICAL FIELD

The present invention relates to a garment with a back part, provided with a back cloth having a fastening effect for making the garment be fixed by being fitted to an area from underarm parts through a back of a wearer, such as a brassiere, a bra-slip, a body suit, and a bathing suit.

BACKGROUND ART

A brassiere, which is a typical garment with the back cloth, is generally composed of left and right cup cloths, an under cup cloth to be sewn to a lower end portion of the cup cloths, left and right back cloths to be fitted and fixed to an area from the underarm part through the back part, and straps.

The brassiere composed of the above-mentioned parts can be put on and off by engaging and disengaging hooks with eyes. The hooks and the eyes are sewn onto tape fabric materials which are relatively thick and which are provided separately from the backcloths. That is, to an end portion of one back cloth, the tape fabric material provided with eyes which are arranged in a plurality of lines at constant intervals is sewn, and a hook tape fabric material provided with hooks to be engaged with the eyes is sewn to an end portion of the other back cloth. The hooks and the eyes are engaged and disengaged to enable the brassiere to be put on and off.

A tape provided with the eyes is provided with covering cloths for hiding an attachment base of the eyes, the eyes being arranged in three rows, which are an upper row, a middle row, and a lower row in order to allow an adjustment according to a size of a bust of a wearer when the brassiere is to be worn. The covering cloth for the upper row is sewn onto a surface of a base cloth tape, the covering cloth for the middle row is sewn onto the covering cloth for the upper row, and the covering cloth for the lower row is sewn onto the covering cloth for the middle row. By changing a position of the eyes with which the hooks are engaged or disengaged, a fastening level can be adjusted, and an eye tape that increases in thickness toward the lower row is commonly known (see, for example, JP 2002-28009 A).

The above-mentioned eye tape is made thick by overlapping a plurality of covering cloths, thereby requiring a preparation for facilitating sewing such as a creasing process prior to a sewing operation, which takes time and effort, and only a skilled person can perform the sewing operation. Further, a sewing thread used in sewing by a sewing machine appears on front and back surfaces of the tape, resulting in that contact of the sewing thread with skin provides an uncomfortable feeling, or that contact of a concave and a convex generated on a surface of the sewing thread causes skin disorders and an itch in some cases. Moreover, in a case of wearing a thin outerwear, there is a problem in that a bulge of the thick part appears on an outer surface of the wear, thereby deteriorating an appearance.

As means for eliminating such a defect, there is known a hook/eye tape of a type in which hooks/eyes are attached to a relatively thin tape fabric materials and the thin tape fabric materials are joined to the back cloth by thermal welding using a thermal adhesive film without being sewn thereto. The sewing thread does not appear on the outer surface of the hook/eye tape by sewing, so the hook/eye tape provides an excellent appearance and does not provide a feeling of stiffness with the thick material or uncomfortable feeling of wearing. Accordingly, the hook/eye tape has a good reputation (see, for example, Japanese Utility Model Registration No. 3104261).

SUMMARY OF THE INVENTION

Problem to be Solved by the Invention

However, the hook/eye tape of a type using the thermal adhesive film according to Patent Document 2 mentioned above is joined to an outer surface of one end portion of the back cloth, thereby appearing on the outer surface to provide an unfavorable appearance. Further, a portion of the backcloth and a portion with the hook/eye tape overlapped thereon become uneven providing a concave and a convex resulting in a problem in that uncomfortable feeling of wearing is caused.

The present invention has been studied and developed in view of solving the above-mentioned problems, and an object of the present invention is to provide a garment including a brassiere with a back part, in which the hook/eye tapes are not provided on the outer surfaces of the back cloths thereby generating no concave and convex, which are formed thin and has only a head parts of male and female engaging devices appearing on the outer surfaces of the back cloths, thereby providing a stylish appearance which is simple and neat and a comfortable feeling of wearing without generating feeling of discomfort.

Means for Solving the Problems

As means for solving the above-mentioned problems and attaining the object of the present invention, there is developed and adopted a garment including a brassiere with a back part, which can be put on and off by using male and female engaging devices provided on back cloths to be fitted to an area from underarm parts through a back of a wearer, in which the male and female engaging devices are integrally attached to inner surfaces of the back cloths and head parts of the male and female engaging devices are exposed to an outside through slits.

Further, according to the present invention, in the garment with the back part such as the brassiere structured as described above, there are provided a garment including a brassiere with a back part, in which the back cloth is a thin fabric material obtained by thermally welding a stretch front fabric material and a stretch back fabric material using a thermal adhesive film, a garment including a brassiere with a back part, in which the back cloths are formed so as to have no concave and convex in portions to which the male and female engaging devices are attached, a garment including a brassiere with a back part, in which the thermal adhesive film is provided with an opening portion along a longitudinal direction thereof, and a garment including a brassiere with a back part, in which the male and female engaging devices are composed of a hook and an eye.

Effects of the Invention

According to the present invention, the male and female engaging devices are integrated in inner surface portions of the back cloths and only the head parts of the male and female engaging devices appear on the outer surfaces of the back cloths, so there is no concave and convex which are found in a case of the conventional hook/eye tape and the whole garment is formed to be uniform in thickness and thin. Therefore, the garment according to the present invention eliminates the feeling of discomfort due to biting into skin of a wearer or a partially applied pressure and fits a body with a moderate fastening force. Further, a slim appearance of the backcloth provides a neat and elegant appearance of the garment, and the garment does not stand out even in a case of wearing a thin outerwear. Moreover, the thermal adhesive film is provided with a window portion in the longitudinal direction thereof, so air permeability is not impaired when a front fabric material and a back fabric material are joined therethrough, thereby providing a comfortable feeling of wearing, and there is an advantage that stretchability and strength of the garment can be freely changed.

DETAILED DESCRIPTION OF THE INVENTION

Figure 1:
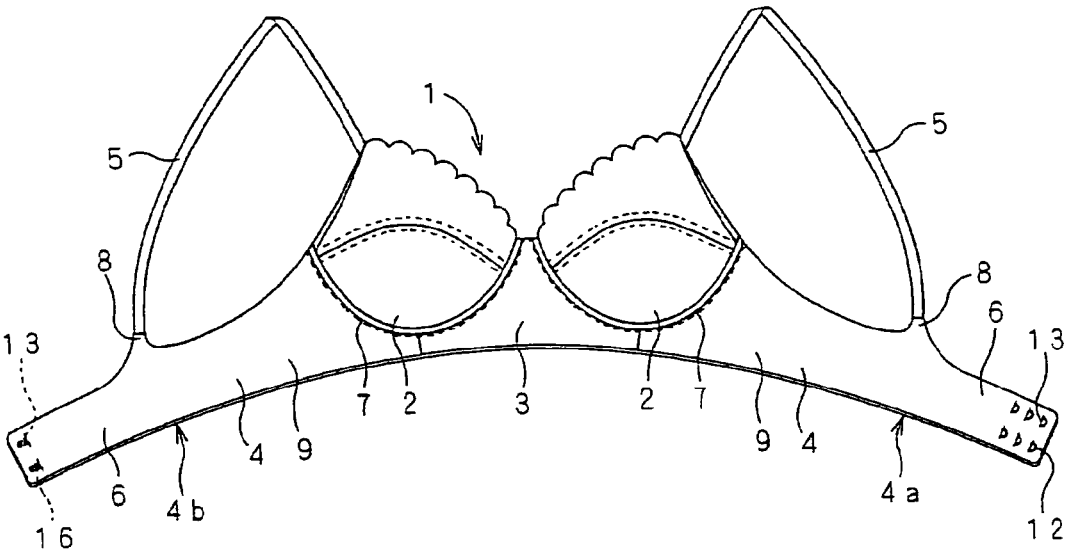
FIG. 1 is a front view of a brassiere.
Figure 2:
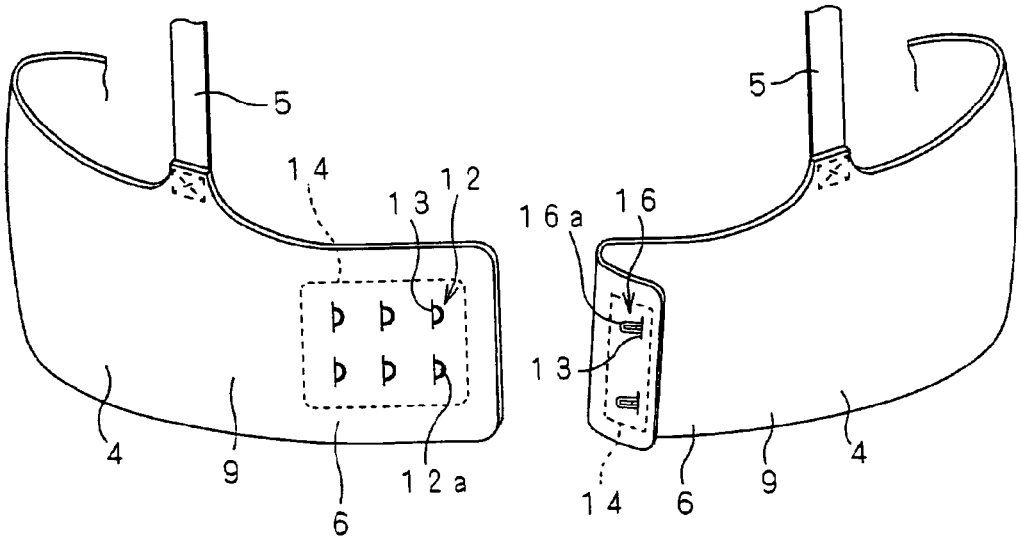
FIG. 2 is a back view of a back part.

Hereinafter, a garment with a back part according to an embodiment of the present invention will be explained by taking a brassiere as a typical example. As shown in FIG. 1, a brassiere main body 1 is composed of a pair of left and right cup cloths 2 for covering breasts (i.e. a front of a wearer), an under cup cloth 3 connected to the pair of cup cloths 2, back cloths 4 (i.e., back bands) to be put on an area from underarm sides of the cup cloths 2 to a back of a wearer, and straps 5 for connecting upper ends of the cup cloths 2 and upper sides of the back cloths 4.

Figure 3:
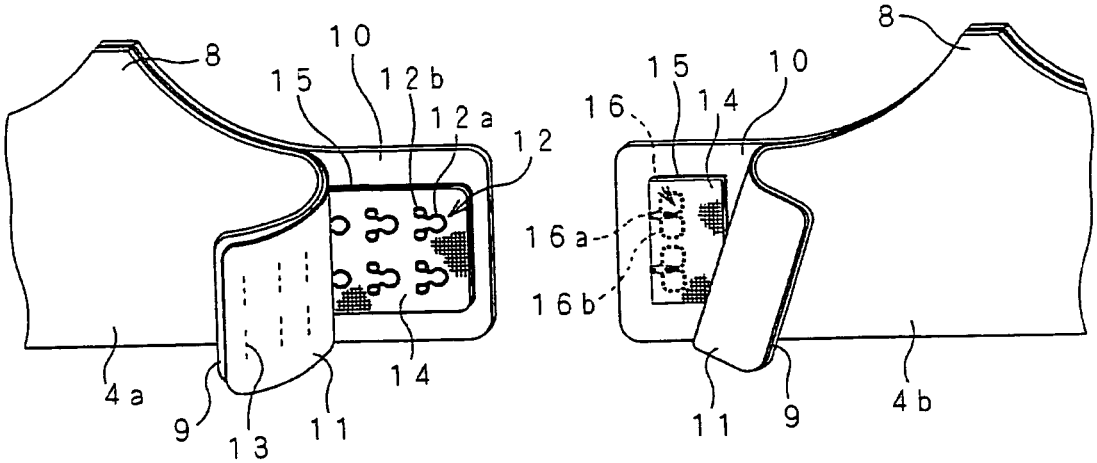
FIG. 3 is an exploded view of a main part of the back part.
Figure 4:
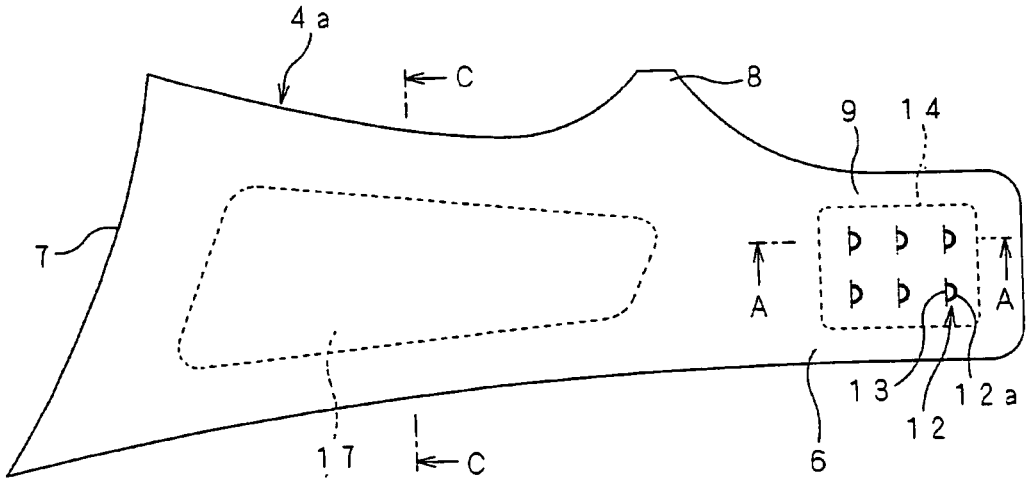
FIG. 4 is a front view of a left backcloth.
Figure 5:
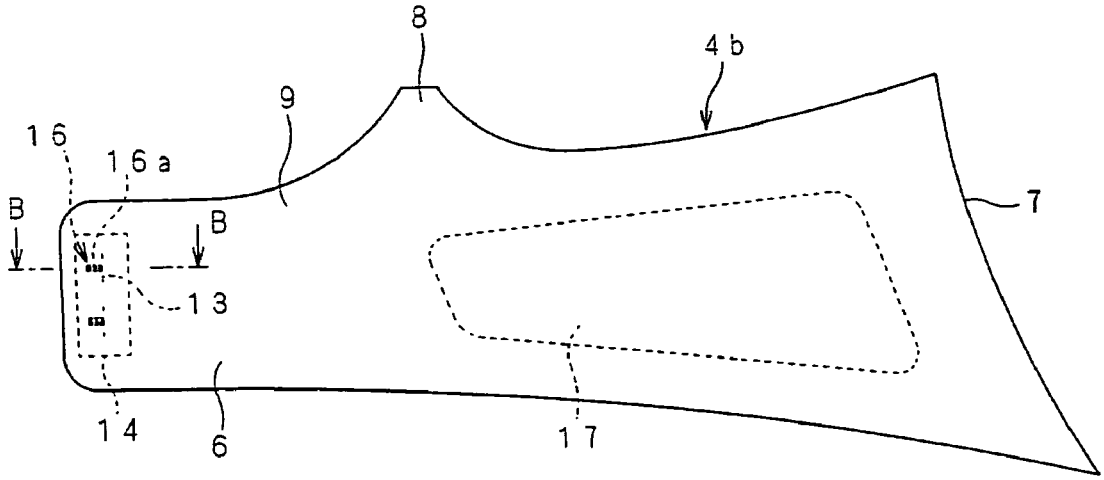
FIG. 5 is a front view of a right backcloth.
Figure 6:
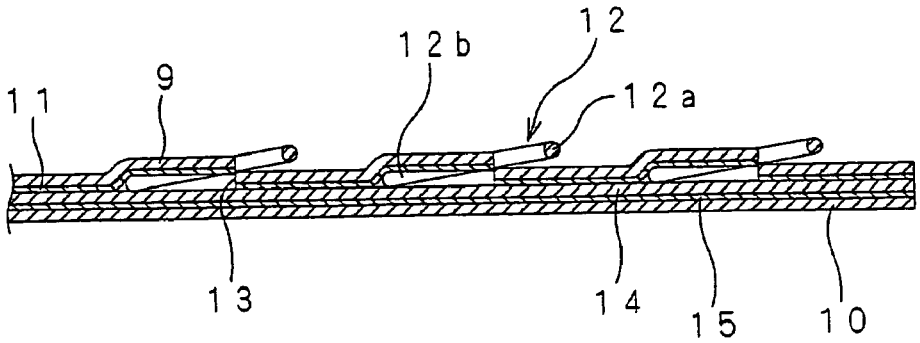
FIG. 6 is an enlarged sectional view taken along the line A-A of FIG. 4.
Figure 7:
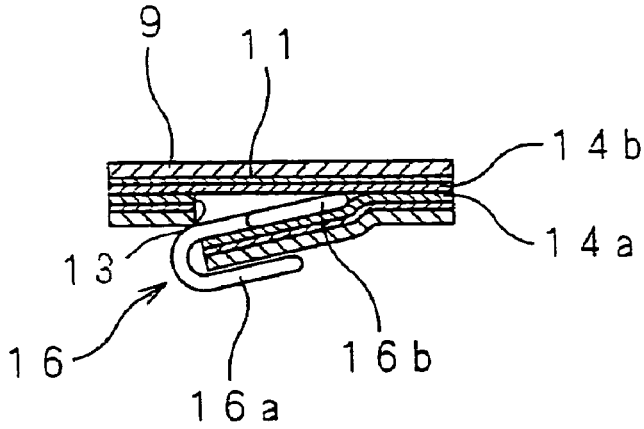
FIG. 7 is an enlarged sectional view taken along the line B-B of FIG. 5.
Figure 8:
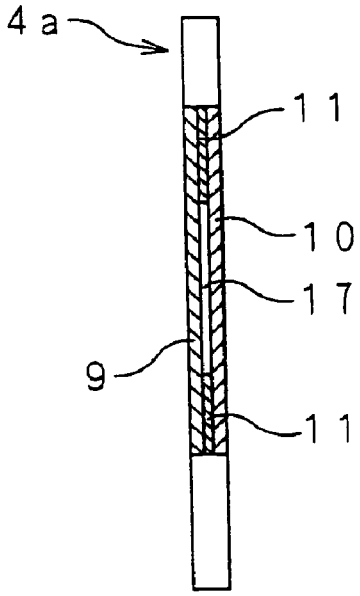
FIG. 8 is a sectional view taken along the line C-C of FIG. 4.

All of the cup cloths 2, the under cup cloth 3, and the straps 5 are the same as those conventionally known, so descriptions of those will be omitted, and the back cloths 4 will be described. That is, as shown in FIGS. 3 to 5, a portion along the back of the wearer is formed into a narrow band 6 and the back cloth 4 is formed so as to gradually increase in width between upper and lower sides from the narrow band 6 toward the cup cloth 2. An end portion of the backcloth 4 is formed into an arcuate surface 7 to be sewn to a side edge portion of the cup cloth 2. An upper side portion of the backcloth 4 is formed to have a protruding part 8 connected to the strap 5.

While the back cloth 4 has stretchability in both warp and weft directions, a stretch warp knitted fabric material having larger stretchability in the weft direction such as a power net is suitable therefor. The back cloth 4 has upper and lower sides and both lateral sides which are resistant to fraying, and formed into a thin fabric material having a thickness of about 1.0 mm with a front fabric material and a back fabric material thermally welded to each other through an intermediation of a urethane elastomer film 11 therebetween.

Figure 9:
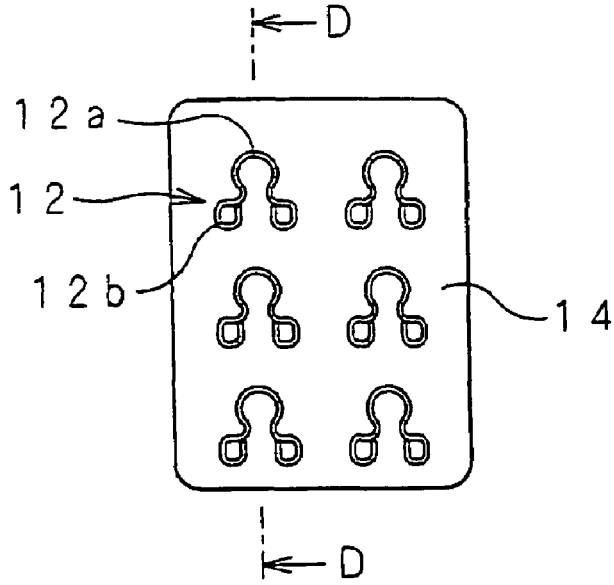
FIG. 9 is a front view of an eye tape.
Figure 10:
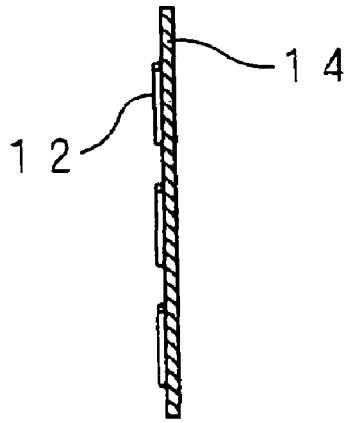
FIG. 10 is a sectional view taken along the line D-D of FIG. 9.

As shown in FIG. 4, in a left back cloth 4*a*, loop parts 12*a* constituting head parts of eyes 12 protrude from longitudinal slits 13 arranged at predetermined intervals on the front fabric material 9 in one end portion of the narrow band 6. In other words, as shown in FIG. 3, between the front fabric material 9 and the back fabric material 10, there are provided a urethane elastomer film 11, a tape cloth 14 to which leg parts 12*b* of the eyes 12 are attached using sewing threads as shown in FIGS. 9 and 10, and a urethane elastomer film 15 having a square shape which is the same in shape and size as the tape cloth 14, with only the loop parts 12*a* of the eyes 12 being exposed to an outside through the longitudinal slits 13 provided in the front fabric material 9, and heat is applied from the surface of the front fabric material 9 to integrate the whole.

Figure 11:
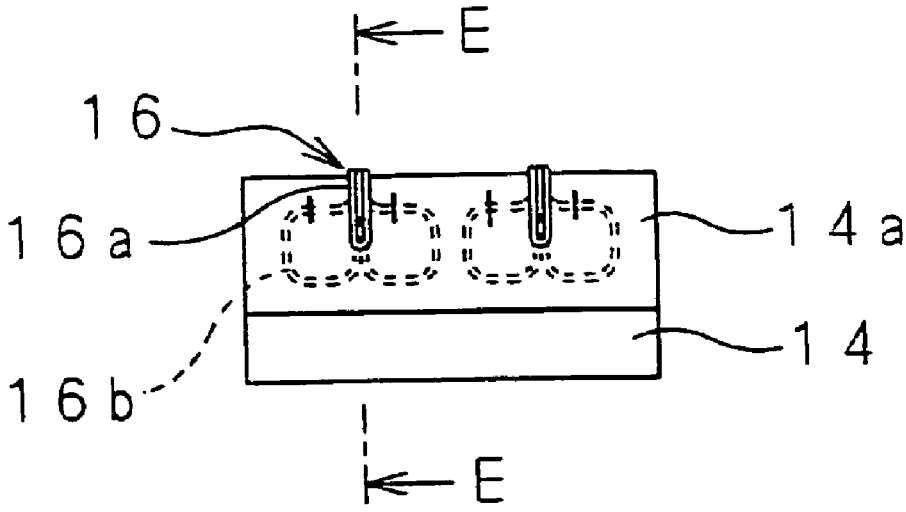
FIG. 11 is a front view of a hook tape.
Figure 12:
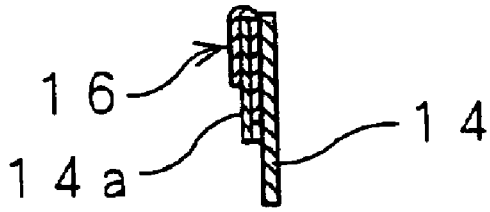
FIG. 12 is a sectional view taken along the line E-E of FIG. 10.

On the other hand, as shown in FIG. 5, in a right back cloth 4*b*, hook parts 16*a* constituting head parts of hooks 16 are exposed to the outside through the longitudinal slits 13 provided on the back fabric material 10 in one end portion of the narrow band 6. In other words, as shown in FIG. 3, between the front fabric material 9 and the back fabric material 10, there are provided the urethane elastomer film 15, the tape cloth 14 to which a covering cloth 14*a* for covering leg parts 16*b* of the hooks 16 and the leg parts 16*a* of the hooks 16 are attached using the sewing threads as shown in FIGS. 11 and 12, and the urethane elastomer film 15 having a square shape which is the same in shape and size as the tape cloth 14, with only the hook parts 16*a* of the hooks 16 being exposed to the outside through the longitudinal slits 13 provided in the back fabric material 10, and heat is applied from the surface of the front fabric material 9 to integrate the whole.

Figure 13:
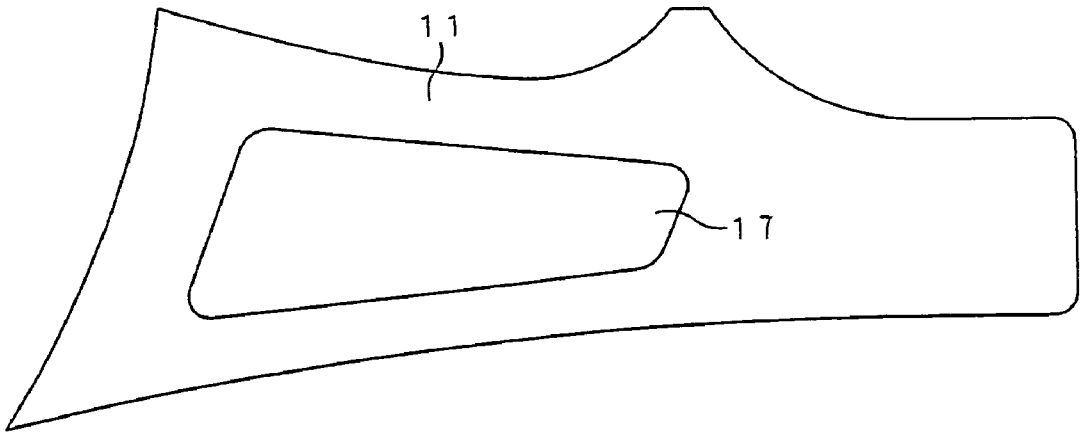
FIG. 13 is a front view of a thermal adhesive film.
Figure 14:
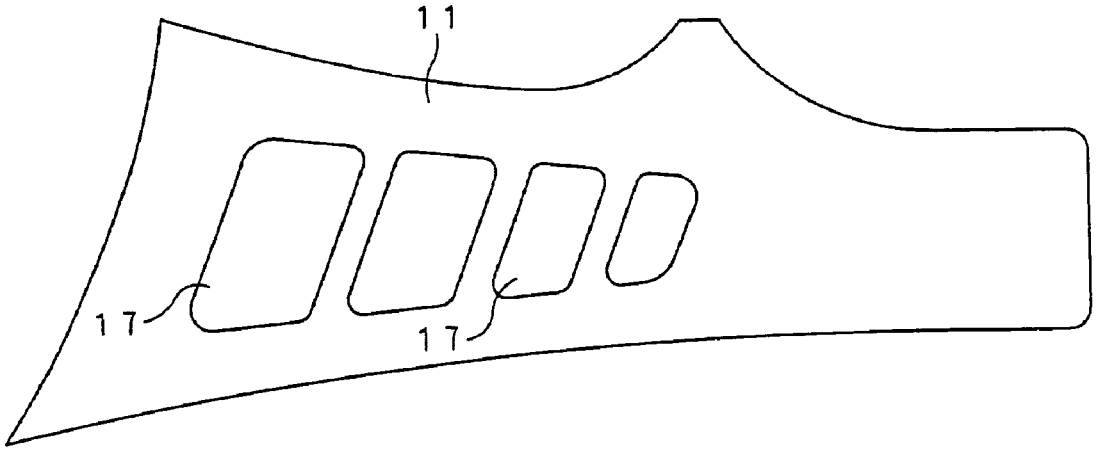
FIG. 14 is a front view of another thermal adhesive film.

The urethane elastomer film 11, for joining and integrating the front fabric material 9 and the back fabric material 10 with each other, is substantially the same in shape and size as the back cloth 4 as shown in FIGS. 13 and 14. A long opening 17 may be provided along a longitudinal direction of the film as shown in FIG. 13, or a plurality of openings 17 may be provided along the longitudinal direction thereof as shown in FIG. 14. When the front fabric material 9 and the back fabric material 10 are joined and integrated with each other, owing to presence of the openings 17, portions of those are not welded, so air permeability is not impaired and stretchability and power of the back cloth can be freely changed.

Conditions of use of the brassiere as a typical example of the garment with the back part such as a brassiere according to the present invention formed as described above is explained in terms of advantages and effects. Between the front fabric material 9 and the back fabric material 10 at one end of the left back cloth 4*a*, the tape cloth 14 to which the eyes 12 are attached is interposed, with the urethane elastomer film 11 sandwiched between the front fabric material 9 and the back fabric material 10, and pressure is applied from an upper surface of a front cloth 2 by using an iron or the like, to thereby thermally weld the front fabric material 9 and the back fabric material 10 and integrate the eyes 12 as well, which are interposed between inner surfaces of those. Accordingly, the tape cloth 14 is hidden by the front fabric material 9 and the back fabric material 10 and does not appear on the outer surface, thereby providing a neat and elegant appearance.

In addition, the back cloth 4, obtained by integrating the front fabric material 9 and the back fabric material 10 with each other by thermal welding, is a thin fabric material having a thickness of about 1.0 mm and has large stretchability in the warp and weft directions, and especially in the lateral direction. Therefore, fastening for an area from the underarm parts through the back part is moderate, and the brassiere fits a body even at a time of exercising without shift in position.

Further, in the backcloth, a concave and a convex are not generated even in positions to which the hooks and the eyes are attached, so there are substantially no irregularities. Accordingly, when worn, the brassiere provides excellent contact with skin and a comfortable feeling of wearing, and feeling of pressure or a feeling of discomfort is not generated.

It should be noted that, while in the above-mentioned embodiment a case where the eyes 12 are provided in three rows in the longitudinal direction, each line having two of them on the left and right, is described. However, the present invention is not limited to the embodiment. The eyes 12 may be provided in one line or two lines, and it goes without saying that various design modifications can be made as long as the object of the invention can be attained and the gist of the invention is maintained.

INDUSTRIAL APPLICABILITY

The present invention is not limited to a brassiere, and can be applied to a garment with a back part in general such as a bra-slip, a body suit, and a bathing suit.

The invention claimed is:

1. A garment comprising:

a portion arranged to cover a front of a wearer; and a back part, including back bands arranged to extend from underarm parts of a wearer, respectively, to a back of the wearer, wherein each of the back bands includes a stretchable front fabric material arranged to face away from the wearer, a stretchable back fabric material arranged to face the wearer, and a thermal adhesive film provided between the front fabric material and the back fabric material, the front fabric material, back fabric material and thermal adhesive film being thermally welded together, wherein a first one of the back bands includes male engaging devices integrally attached to an inner surface of the first one of the back bands between the front fabric material and the back fabric material of the first one of the back bands, the male engaging devices being arranged such that head portions of the male engaging devices protrude through slits provided in one of the front fabric material and the back fabric material so as to be exposed to an outside of the garment, wherein a second one of the back bands includes female engaging devices integrally attached to an inner surface of the second one of the back bands between the front fabric material and the back fabric material of the second one of the back bands, the female engaging devices being arranged such that head portions of the female engaging devices protrude through slits provided in the other of the front fabric material and the back fabric material as compared to the slits of the first one of the back bands so as to be exposed to an outside of the garment, wherein the head portions of the male and female engaging devices are engageable with each other for fastening the garment at the back of the wearer.

2. A garment according to claim 1, wherein the back bands are formed so that the back bands do not have a concavity and a convexity at portions of the back bands to which the male and female engaging devices are attached.

3. A garment according to claim 2, wherein the thermal adhesive film is provided with an opening along a longitudinal direction thereof.

4. A garment according to claim 3, wherein the male and female engaging devices comprise a hook and an eye, respectively.

5. A garment according to claim 2, wherein the male and female engaging devices comprise a hook and an eye, respectively.

6. A garment according to claim 1, wherein the thermal adhesive film is provided with an opening along a longitudinal direction thereof.

7. A garment including according to claim 6, wherein the male and female engaging devices comprise a hook and an eye, respectively.

8. A garment according to claim 1, wherein the male and female engaging devices comprise a hook and an eye, respectively.

* * * * *